US009187810B2

(12) United States Patent
Weinl et al.

(10) Patent No.: US 9,187,810 B2
(45) Date of Patent: Nov. 17, 2015

(54) CERMET BODY AND A METHOD OF MAKING A CERMET BODY

(75) Inventors: Gerold Weinl, Älvsjö (SE); Malin Mårtensson, Nacka (SE)

(73) Assignee: Sandvik Intellectual Property AB, Sandviken (SE)

( * ) Notice: Subject to any disclaimer, the term of this patent is extended or adjusted under 35 U.S.C. 154(b) by 431 days.

(21) Appl. No.: 12/630,998

(22) Filed: Dec. 4, 2009

(65) Prior Publication Data

US 2010/0150769 A1 Jun. 17, 2010

(30) Foreign Application Priority Data

Dec. 16, 2008 (EP) ..... 08171776

(51) Int. Cl.
*C22C 29/10* (2006.01)
*C22C 1/05* (2006.01)
*B22F 5/00* (2006.01)

(52) U.S. Cl.
CPC ..... *C22C 29/10* (2013.01); *C22C 1/051* (2013.01); *B22F 2005/001* (2013.01)

(58) Field of Classification Search
CPC ..... C22C 29/10; B22F 2005/001
USPC ..... 75/241
IPC ..... B22F 1/0003, 7/06
See application file for complete search history.

(56) References Cited

U.S. PATENT DOCUMENTS

| | | | | |
|---|---|---|---|---|
| 7,217,390 | B2 | 5/2007 | Shim et al. | |
| 7,799,443 | B2 | 9/2010 | Mikus et al. | |
| 2003/0000340 | A1 * | 1/2003 | Mende et al. | 75/351 |

FOREIGN PATENT DOCUMENTS

| | | | |
|---|---|---|---|
| CN | 1865477 | | 11/2006 |
| CN | 1865477 | A * | 11/2006 |
| CN | 101028751 | | 9/2007 |
| EP | 0 505 991 | | 9/1992 |
| FR | 1142141 | | 9/1957 |
| GB | 1037568 | | 7/1966 |
| JP | 61-199048 | | 9/1986 |
| JP | 62-211340 | | 9/1987 |
| JP | 2-066135 | | 3/1990 |
| JP | 7-076743 | | 3/1995 |
| WO | WO 2008/147660 | | 12/2008 |

OTHER PUBLICATIONS

European Search Report dated Jun. 17, 2009 issued in European Application No. 08171776.1.

(Continued)

*Primary Examiner* — Weiping Zhu
(74) *Attorney, Agent, or Firm* — Morgan, Lewis & Bockius LLP

(57) ABSTRACT

The invention relates to a cermet body essentially free from nitrogen where the binder phase is Co in an amount of from about 5 to about 25 vol % Co, further comprising TiC and WC in amounts so that the atomic Ti:W ratio is from about 2.5 to about 10. The cermet body further comprising Cr in an amount such that the atomic Cr:Co ratio is from about 0.025 to about 0.14. The cermet body is free from nucleated of Ti—W—C cores. The invention also relates to a method of making a cermet body.

24 Claims, 1 Drawing Sheet

(56) References Cited

OTHER PUBLICATIONS

CRC Handbook of Chemistry and Physics, 75th Ed., 1994/95, pp. 12-180 to 12-181.
Notification of Second Office Action (with English Translation) for Chinese Patent Application No. 200910260504.6 dated Sep. 9, 2013.
Notification of First Office Action (with English Translation) for Chinese Patent Application No. 200910260504.6 dated Oct. 23, 2012.
Notice of Reasons for Rejection (with English Translation) for Japanese Patent Application No. 2009-281810 dated Mar. 4, 2014.
Office Action for European Patent Application No. 08171776.1 dated Sep. 8, 2009.

* cited by examiner

CERMET BODY AND A METHOD OF MAKING A CERMET BODY

CROSS-REFERENCE TO PRIOR APPLICATION

This application claims priority to European Application No. 08 171 776.1-1215 filed Dec. 16, 2008, which is incorporated by reference herein.

BACKGROUND OF THE INVENTION

The present invention relates to a TiC-based cermet body with a reduced amount of pores and an increased hardness and also a method of making such cermet body.

Sintered bodies like cutting tool inserts, etc., are usually made from materials containing cemented carbides or titanium based carbide or carbonitride alloys, often referred to as cermets.

Materials like cermets usually contain one or more hard constituents such as carbides or carbonitrides of, e.g., tungsten, titanium, tantalum, niobium, etc., together with a binder phase. Depending on composition and grain size, a wide range of materials combining hardness and toughness can be used in many applications, for instance in metal cutting tools, in wear parts, etc. The sintered bodies are made by techniques common in powder metallurgy like milling, granulation, compaction and sintering. The binder phase in cermets is usually Co, Fe or Ni or mixtures thereof.

The first cermet materials developed were TiC-based. The cermet materials were then further developed and in the eighties, carbonitride-based cermets were introduced and a large part of the cermet materials developed since then are carbonitride-based.

For conventional cemented carbide, i.e., WC—Co based, fine grained particles after sintering can be obtained by adding chromium. However, when adding chromium to a carbonitride based cermet, little or no effect on the grain size can be seen.

CN 1865477 A discloses a guide roll, spool or valve seat of a TiC—WC based alloy comprising 30-60 wt % TiC, 15-55 wt % WC, 0-3 wt % Ta, 0-3 wt % Cr and 10-30 wt % of a binder phase being Co and Ni.

U.S. Pat. No. 7,217,390 describes a method of making an ultra-fine TiC-based cermet by obtaining mechano-chemical synthesis, e.g., high-energy ball-milling of powders of Ti, transition metal (TM), Co and/or Ni powders and carbon powders. Alternatively the Ti and transitional metals can be added as carbides. The transition metal, TM, can be at least one element of Mo, W, Nb, V or Cr. The high-energy ball-milling will form (Ti,TM)C.

However, high-energy ball-milling is a complicated process and it would be beneficial to be able to provide a fine-grained TiC-based cermet using conventional techniques.

OBJECTS AND SUMMARY OF THE INVENTION

It is an object of the present invention to provide a cermet body with an increased hardness at a maintained binder phase content.

It is an object of the present invention to provide a full density sintered body with reduced porosity.

It is yet a further object of the present invention to provide a method of making a cermet body with the benefits as disclosed above.

It is yet a further object of the present invention to provide a method of making a cermet body which makes it possible to control the as sintered TiC average grain size through the choice of raw material.

In one aspect of the invention, there is provided a cermet body essentially free from nitrogen where the binder phase is Co in an amount of from about 5 to about 25 vol % Co, further comprising TiC and WC in amounts so that the atomic Ti:W ratio is between about 2.5 and about 10, wherein the cermet body further comprises Cr in an amount such that the atomic Cr:Co ratio is from about 0.025 to about 0.14.

In another aspect of the invention, there is provided a method of making a cermet body essentially free from nitrogen comprising the steps of forming a mixture of powders forming hard constituents comprising TiC and WC and cobalt powders, forming the binder phase by milling, granulation of said mixture, pressing and sintering to a cermet body wherein cobalt is added in an amount so that the cobalt binder phase will constitute from about 5 to about 25 vol % of the cermet body after sintering, TiC and WC are added in amounts so that the atomic Ti:W ratio is from about 2.5 to about 10, and Cr is added in an amount such that the atomic Cr:Co ratio is from about 0.025 to about 0.14.

DETAILED DESCRIPTION OF THE PREFERRED EMBODIMENTS

Figure 1:
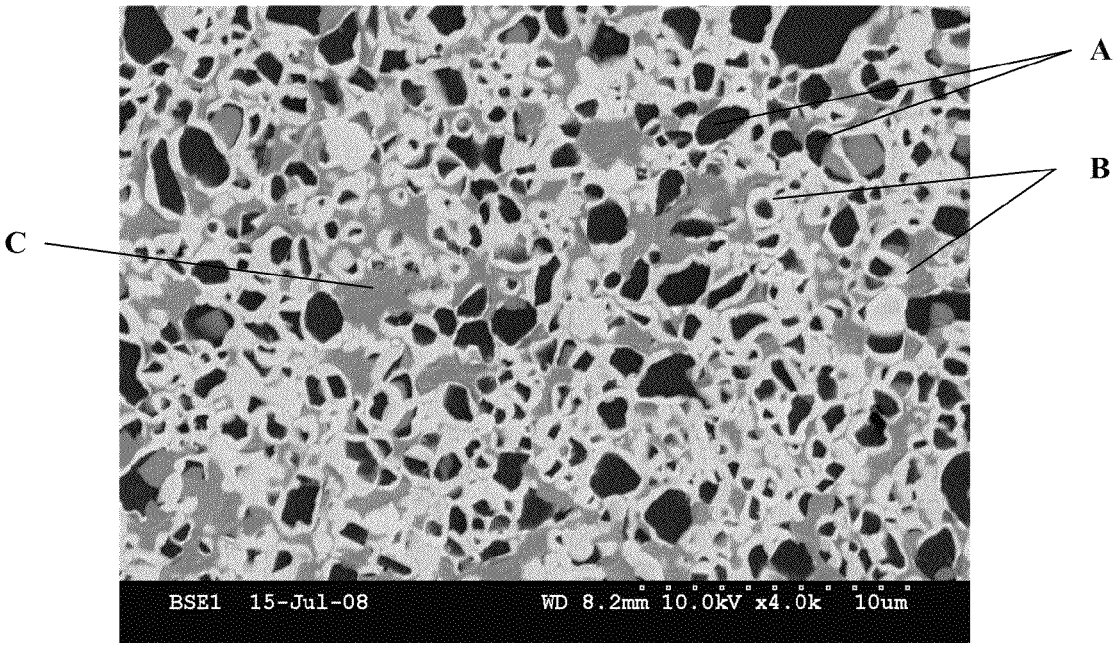
FIG. 1 shows a backscattered SEM image in 4000× magnification of a picture of a sintered structure according to invention 2 in Example 4 where A is un-dissolved TiC-cores (black), B is Ti—W—C rims (white) and C is binder phase Co—Cr (grey).
Figure 2:
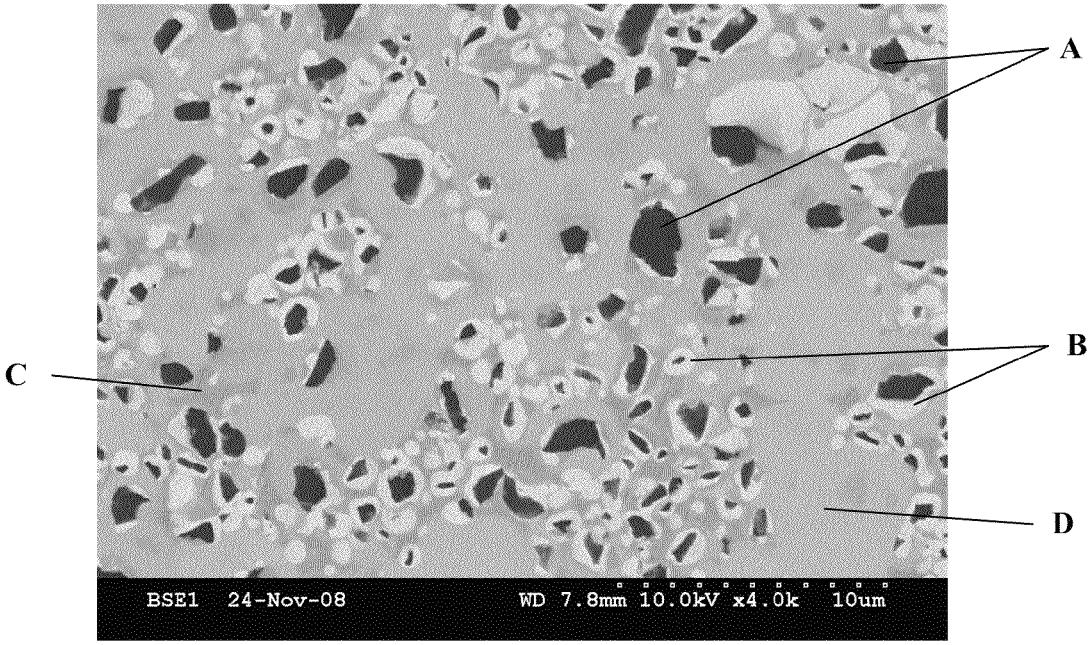
FIG. 2 shows a backscattered SEM image in 4000× magnification of a picture of a sintered structure according to reference 3 in Example 4 where A is un-dissolved TiC-cores (black), B is Ti—W—C rims (white), C is binder phase Co—Cr (grey) and D is nucleated Ti—W—C(light grey).

It has now been found that by providing a TiC-based cermet body comprising Cr, being essentially free from nitrogen, and having a structure with un-dissolved TiC cores, and no nucleated Ti—W—C cores, the benefits of reduced porosity and increased hardness can be obtained.

The present invention relates to a cermet body essentially free from nitrogen where the binder phase is Co in an amount of from about 5 to about 25 vol % Co, further comprising TiC and WC in amounts so that the atomic Ti:W ratio is between about 2.5 and about 10. The cermet body further comprises Cr in an amount such that the atomic Cr:Co ratio is from about 0.025 to about 0.14.

By essentially free from nitrogen is herein meant that the cermet body comprises less than about 0.2 wt % of nitrogen, preferably free from nitrogen.

The cermet body is further essentially free from Ti—W—C cores. The properties of the cermet body will deteriorate if Ti—W—C cores are present. However, very few, isolated, Ti—W—C cores might be present without affecting the properties.

The cermet body according to the present invention comprises un-dissolved TiC cores having a peripheral part, so called rims, of Ti—W—C alloy. The TiC cores are the same as those originating from the TiC grains added as raw material. All properties referring to raw materials mentioned herein are the properties of the raw material after milling. In TiC-based cermets according to prior art, a large amount of the TiC has been dissolved and new Ti—W—C cores have been formed which leads to uncontrolled Ti—W—C grain size and deterioration of properties like hardness. In the cermet body according to the present invention, a high amount of the added TiC cores are still present after sintering. The relation between the amount of TiC cores present after sintering to full density and the amount of TiC cores in the raw material is expressed as the ratio, $x_{TiC}$:

$$x_{TiC}=TiC_{ALR}/TiC_{VR,raw} \quad (1)$$

where $TiC_{ALR}$=the TiC-average length ratio of the TiC cores in the sintered material $TiC_{VR,raw}$=the volume fraction of the TiC in the raw material.

The amount of remaining TiC-cores after sintering to full density is determined by making at least 10 lines, $L_m$, where m=1, 2 . . . , m in a backscattered SEM-picture and measuring the length of n TiC-core intercepts ($l_{TiCn}$) along the line $L_m$. The TiC-average length ratio ($TiC_{ALR}$) in each picture is calculated as $\Sigma l_{TiCn,m}/\Sigma L_m$.

The volume fraction of TiC in the raw material ($TiC_{VR,raw}$) is calculated either from the weighed mass of TiC in relation to total mass in the raw material, or using the analyzed composition in the sintered material and assuming that all Ti originate from TiC, by using the X-ray densities tabulated in CRC Handbook of Chemistry and Physics 75$^{th}$ Ed, 1994/95, pages 12-180 to 12-181.

The ratio $x_{TiC}$ is suitably larger than about ⅕, more preferably larger than about ¼, most preferably larger than about ⅓.

Although the average grain size of the TiC grains in the sintered body will be smaller than the average grain size of the raw material due to some dissolving during sintering, the grain size distribution is only shifted compared to that of the raw material, i.e., the grain size distribution can be controlled by the properties of the TiC raw material. This means that the standard deviation from the average grain size of the TiC raw material will not deviate more than 10% from the standard deviation from the average grain size of the TiC in the sintered state.

The binder phase is Co suitably present in an amount of from about 5 to about 25 vol %, preferably from about 7 to about 20 vol %, most preferably from about 8 to about 17 vol %.

In one embodiment of the present invention, the cermet body comprises Co in an amount of from about 5 to about 12 vol % and then preferably has a hardness of between about 1700 to about 2500 HV3, preferably between about 1800 to about 2400 HV3 depending on the TiC-grain size in the raw material and the Ti/W-ratio.

In one embodiment of the present invention, the cermet body comprises Co in an amount of from about 12 to about 25 vol % and then preferably has a hardness of between about 1400 to about 2000 HV3, preferably between about 1500 to about 1900 HV3 depending on the TiC-grain size in the raw material and the Ti/W-ratio.

The amount of chromium in the cermet body according to the present invention is dependent on the ability of the Co metal to dissolve chromium. The maximum amount of Cr is therefore dependent on the Co amount. The Cr:Co atom ratio is suitably from about 0.025 to about 0.14, preferably from about 0.035 to about 0.09. If chromium is added in amounts exceeding those according to the present invention, it is possible that not all chromium will dissolve into the Co binder phase but instead precipitate as separate chromium containing phases, e.g., as chromium carbides or mixed chromium containing carbides.

The Ti:W atomic ratio is preferably from about 3 to about 8.

It is well known in the art that the cobalt content has a big impact on the hardness and toughness of the cermet body. A high cobalt content leads to a decreased hardness but an increased toughness whereas a low cobalt content leads to a harder and more wear resistant cermet body. According the present invention the Ti:W atomic ratio can be used to improve these properties. Depending on what property that is most preferred to enhance, the Ti:W atomic ratio can be either higher or lower.

In one embodiment of the present invention where an improved hardness and thereby also an improved wear resistance is aimed for, the Ti:W atomic ratio is ranging from about 4.5 to about 10, preferably from about 4.5 to about 8.

In another embodiment of the present invention where an improved toughness is preferred, the Ti:W atomic ratio is ranging from about 2.5 to about 4.5, preferably from about 3 to about 4.5.

The cermet body can also comprise other elements common in the art of cermet making such as elements of group IVa and/or Va, i.e., Ti, Mo, Zr, Hf, V, Nb and Ta providing that the element(s) do not cause any nucleation together with the TiC during sintering.

In another embodiment of the present invention the cermet body has a porosity of between A00B00 and A04B02, preferably A00B00 to A02B02.

Cermet bodies according to the present invention can be used as cutting tools, especially cutting tool inserts. The cermet body preferably further comprises a wear resistant coating comprising single or multiple layers of at least one carbide, nitride, carbonitride, oxide or boride of at least one element selected from Si, Al and the groups IVa, Va and VIa of the periodic table.

The present invention also relates to a method of making a cermet body essentially free from nitrogen comprising the steps of forming a mixture of powders forming hard constituents comprising TiC and WC and cobalt powders forming the binder phase by milling, granulation of said mixture, pressing and sintering to a cermet body. Cobalt is added in an amount so that the cobalt binder phase will constitute from about 5 to about 25 vol % of the cermet body after sintering, TiC and WC are added in amounts so that the atomic Ti:W ratio is suitably from about 2.5 to about 10, and chromium is added in an amount such that the atomic Cr:Co ratio is suitably from about 0.025 to about 0.14.

The Co powder forming the binder phase is added in such amount that the cobalt content in the sintered cermet preferably is about 7 to about 20 vol %, most preferably from about 8 to about 17 vol %.

The amount of chromium that is added is related to the amount of cobalt such that the Cr:Co atomic ratio preferably is suitably from about 0.035 to about 0.09.

In one embodiment of the present invention, the chromium is added as pre-alloyed with cobalt.

In one embodiment of the present invention, the chromium is added as Cr3C2.

The powders forming hard constituents, WC and TiC is added in such amounts that the Ti:W atomic ratio preferably is suitably from about 3 to about 8.

In one embodiment of the present invention where an improved hardness and thereby also an improved wear resistance is aimed for, the powders forming hard constituents are added in such amounts that the Ti:W atomic ratio is suitably ranging from about 4.5 to about 10, preferably from about 4.5 to about 8.

In another embodiment of the present invention where an improved toughness is preferred, the powders forming hard constituents are added in such amounts that the Ti:W atomic ratio is suitably ranging from about 2.5 to about 4.5, preferably from about 3 to about 4.5.

The average TiC grain size in the sintered body can be controlled by both the average grain size of the TiC raw material as well as by the sintering conditions. By choosing the proper sintering conditions, i.e., temperature and time, the degree of dissolvment of the TiC cores can be controlled. Although the average grain size of the TiC grains in the sintered body will be smaller than the average grain size of the raw material due to some dissolving during sintering, the grain size distribution is only shifted compared to that of the raw material, i.e., the grain size distribution can be controlled by the properties of the TiC raw material. This means that the standard deviation from the average grain size of the TiC raw material will not deviate more than 10% from the standard deviation from the average grain size of the TiC in the sintered state.

In one embodiment of the present invention, the method can further comprise the addition of other elements common in the art of cermet making such as elements of group IVa and/or Va, i.e., Ti, Mo, Zr, Hf, V, Nb and Ta providing that the element(s) do not cause any nucleation together with the TiC during sintering.

The raw material powders are milled in the presence of an organic liquid (for instance ethyl alcohol, acetone, etc) and an organic binder (for instance paraffin, polyethylene glycol, long chain fatty acids etc) in order to facilitate the subsequent granulation operation. Milling is performed preferably by the use of mills (rotating ball mills, vibrating mills, attritor mills etc).

Granulation of the milled mixture is preferably done according to known techniques, in particular spray-drying. The suspension containing the powdered materials mixed with the organic liquid and the organic binder is atomized through an appropriate nozzle in the drying tower where the small drops are instantaneously dried by a stream of hot gas, for instance in a stream of nitrogen. The formation of granules is necessary in particular for the automatic feeding of compacting tools used in the subsequent stage.

The compaction operation is preferably performed in a matrix with punches, in order to give the material the shape and dimensions as close as possible (considering the phenomenon of shrinkage) to the dimension wished for the final body. During compaction, it is important that the compaction pressure is within a suitable range, and that the local pressures within the body deviate as little as possible from the applied pressure. This is particularly of importance for complex geometries.

Sintering of the compacted bodies takes place in an inert atmosphere or in vacuum at a temperature and during a time sufficient for obtaining dense bodies with a suitable structural homogeneity. The sintering can equally be carried out at high gas pressure (hot isostatic pressing), or the sintering can be complemented by a sintering treatment under moderate gas pressure (process generally known as SINTER-HIP). Such techniques are well known in the art.

The cermet body is preferably a cutting tool, most preferably a cutting tool insert.

In one embodiment the cermet body is coated with a wear resistant coating comprising single or multiple layers of at least one carbide, nitride, carbonitride, oxide or boride of at least one element selected from Si, Al and the groups IVa, Va and VIa of the periodic table by known CVD-, PVD- or MT-CVD-techniques.

The invention is additionally illustrated in connection with the following examples, which are to be considered as illustrative of the present invention. It should be understood, however, that the invention is not limited to the specific details of the examples.

Example 1

Invention

Two TiC—WC—Co cermet inserts, A and B, were produced by first milling the raw materials TiC, WC, Co and Cr in a ball mill for 50 h in ethanol/water (90/10) mixture. The suspension was spray dried and the granulated powder was pressed and sintered according to conventional techniques. The amounts of added raw material are displayed in Table 1.

TABLE 1

| | WC (wt %) | TiC (wt %) | Ti:W (at. ratio) | Co (wt %) | Cobalt grain size (μm) | Cr-source | Cr:Co (at. ratio) |
|---|---|---|---|---|---|---|---|
| Insert A | 41.2 | 46.4 | 4.6 | 11.9 | 0.9 | Co/Cr alloy (4 wt % of Cr in Co) | 0.05 |
| Insert B | 41.2 | 46.4 | 4.6 | 11.9 | 0.5 | $Cr_3C_2$ powder | 0.05 |

Example 2

Prior Art

Two TiC—WC—Co cermet inserts, C and D, were produced in the same way as in example 1 without the addition of Cr with the cobalt grain sizes shown in Table 2.

TABLE 2

| | Cobalt grain size (μm) | Cr |
|---|---|---|
| Insert C | 0.9 | None |
| Insert D | 0.5 | None |

The composition of the cermets C and D were both 41.2 wt % WC, 46.4 wt % TiC and 12.4 wt % Co.

Example 3

The porosity, hardness and average grain size of the inserts from Example 1 and 2 were evaluated. The porosity was evaluated according to ISO standard 4505 (Hard Metals Metallografic determination of porosity and uncombined carbon). The grain size was measured from scanning electron microscope images using a linear intercept method.

The results can be seen in Table 3 below.

TABLE 3

| Insert | Porosity | Hardness (HV3) | Hc (kA/m) | $TiC_{VR,raw}$ | $TiC_{ALR}$ | $x_{TiC}$ |
|---|---|---|---|---|---|---|
| A (inv.) | A00, B00, A01, B01 | 1852 | 13.55 | 0.70 | 0.24 | 0.34 |
| B (inv.) | A02, B00, A02, B01 | 1845 | 13.22 | 0.70 | 0.23 | 0.33 |
| C (prior art) | A02-A08, B00 | 1715 | 12.40 | 0.70 | 0.11 | 0.16 |
| D (prior art) | A00, B02 | 1627 | 11.83 | 0.70 | 0.9 | 0.13 |

As can bee seen in Table 3, the cermet bodies according to the present invention, A and B, show an improved hardness and porosity compared to the prior art, C and D. Also, there is no significant difference between adding the chromium as a separate $Cr_3C_2$ powder or pre-alloyed with cobalt.

Example 4

Cermet bodies according to the present invention were prepared by mixing TiC having an average grain size of 1.2 μm (measured after milling), WC, $Cr_3C_2$ and Co-powders together with a pressing agent by milling, followed by spray-drying, pressing into green bodies and finally sintering. Cermet bodies outside the scope of the invention were also made in the same way. The amounts of the raw materials for the different cermet bodies are displayed in table 4.

TABLE 4

| Sample | TiC (wt %) | WC (wt %) | Co (wt %) | Cr3C2 (wt %) | Cr (wt %) from Co—Cr alloy | Cr:Co (at. ratio) | Ti:W (at. ratio) |
|---|---|---|---|---|---|---|---|
| Inv. 1 | 48.5 | 31.5 | 19.0 | 0 | 1.01 | 0.06 | 5 |
| Inv. 2 | 46.4 | 41.2 | 11.9 | 0.5 | 0 | 0.05 | 3.7 |
| Ref. 1 | 32.0 | 51.5 | 15.7 | 0 | 0.8 | 0.06 | 2 |
| Ref. 2 | 67.7 | 16.6 | 14.3 | 0 | 1.4 | 0.09 | 13.2 |
| Ref. 3 | 46.4 | 41.2 | 12.4 | 0 | 0 | 0 | 3.7 |

The carbon balance, when Co—Cr alloys were used, was monitored by small additions of carbon black. The properties of the sintered bodies are displayed in Table 5 where the letters a, b and c after each sample name denotes that different sintering temperatures have been used for the same powder composition.

The Vickers hardness HV3 was measured according to ISO standard 3878 (Hardmetals-Vickers hardness test) and the porosity was measured by ISO standard 4505 (Hard Metals Metallografic determination of porosity and uncombined carbon).

In Table 5 it can be seen that cermet bodies according to the present invention, shows a significant improvement in both hardness while maintaining the cobalt content and improved porosity compared to the reference cermet bodies.

TABLE 5

| Sample | Vol % binder phase (Co) | Cr:Co atomic ratio | Sintering temp. (° C.) | Sintering density (g/cm³) | $TiC_{VR,raw}$ | $TiC_{ALR}$ | $x_{TiC}$ | Hardness (HV3) | Porosity |
|---|---|---|---|---|---|---|---|---|---|
| Inv. 1a | 15.2 | 0.06 | 1450 | 7.09 | 0.70 | 0.24 | 0.34 | 1635 | A00B00C00 |
| Inv. 1b | 15.2 | 0.06 | 1400 | 7.09 | 0.70 | n.a. | n.a. | 1651 | A00B00C00 |
| Inv. 1c | 15.2 | 0.06 | 1350 | 7.10 | 0.70 | n.a. | n.a. | 1713 | A00B00C00 |
| Inv. 2a | 10 | 0.05 | 1450 | 7.43 | 0.70 | 0.21 | 0.30 | 1845 | A02B00C00 |
| Inv. 2b | 10 | 0.05 | 1400 | 7.43 | 0.70 | 0.23 | 0.33 | 1891 | A02B00C00 |
| Ref. 1a | 15.2 | 0.06 | 1450 | 8.41 | 0.56 | 0.03 | 0.05 | 1514 | A08B00C00 |
| Ref. 1b | 15.2 | 0.06 | 1400 | 8.37 | 0.56 | n.a. | n.a. | 1466 | C06+ macro porosity* |
| Ref. 1c | 15.2 | 0.06 | 1350 | 8.36 | 0.56 | n.a. | n.a. | 1432 | Macro porosity* |
| Ref. 2a | 9.7 | 0.09 | 1450 | 6.02 | 0.83 | 0.06 | 0.07 | 1761 | A00B00C02 |
| Ref. 2b | 9.7 | 0.09 | 1400 | 6.02 | 0.83 | 0.05 | 0.06 | 1708 | A00B00C00 |
| Ref. 3a | 10.4 | 0 | 1410 | 7.43 | 0.70 | n.a. | n.a. | n.a. | A08* |
| Ref. 3b | 10.4 | 0 | 1480 | 7.51 | 0.70 | 0.09 | 0.13 | 1627 | A00B02C00 |

*Not full density

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A sintered cermet body comprising:

a binder phase, wherein the binder phase consists essentially of Co, in an amount of from about 5 to about 25 vol % of the cermet body, and Cr, and a plurality of grains including a core of undissolved TiC and a rim of (Ti,W)C, wherein an atomic Ti:W ratio is between about 2.5 and about 10, wherein an atomic Cr:Co ratio is from about 0.025 to about 0.14, and wherein the cermet body is essentially free from nitrogen.

2. A sintered cermet body according to claim 1 wherein the Cr:Co atomic ratio is from about 0.035 to about 0.09.

3. A sintered cermet body according to claim 1 wherein the undissolved TiC cores originate from TiC added as raw material, and wherein the ratio $x_{TiC}=TiC_{ALR}/TiC_{VR,raw}$, where $TiC_{ALR}$ is the TiC-average length ratio of the undissolved TiC cores in the sintered cermet body and $TiC_{VR,raw}$ is the volume fraction of the TiC in the raw material, is larger than about 1/5.

4. A sintered cermet body according to claim 3 wherein the ratio $x_{TiC}=TiC_{ALR}/TiC_{VR,raw}$, is larger than about 1/3.

5. A sintered cermet body according to claim 1 wherein the cermet body comprises cobalt in an amount of from about 5 to about 12 vol % and where the cermet body has a hardness of from about 1700 to about 2500 HV3.

6. A sintered cermet body according to claim 1 wherein the cermet body comprises cobalt in an amount of from about 12 to about 25 vol % and where the cermet body has a hardness of from about 1400 to about 2000 HV3.

7. A sintered cermet body according to claim 1 wherein the atomic Ti:W ratio is from about 4.5 to about 10.

8. A sintered cermet body according to claim 1 wherein the atomic Ti:W ratio is from about 2.5 to about 4.5.

9. A sintered cermet body according to claim 1 wherein the amount of Co in the cermet body is from about 8 to about 17 vol % Co.

10. A sintered cermet body according to claim 1 wherein the atomic Ti:W ratio is from about 3 to about 4.5.

11. A sintered cermet body according to claim 1 wherein the cermet body has a porosity of between A00B00 and A04B02.

12. A sintered cermet body comprising:

a binder phase, wherein the binder phase consists essentially of Co, in an amount of from about 5 to about 25 vol % of the cermet body, and Cr, and a plurality of grains including a core of undissolved TiC and a rim of Ti—W—C, wherein an atomic Ti:W ratio is between about 2.5 and about 10, wherein an atomic Cr:Co ratio is from about 0.025 to about 0.14, wherein the cermet body is essentially free from nitrogen, and wherein the cermet body is essentially free from Ti—W—C cores.

13. A sintered cermet body consisting essentially of:

a binder phase consisting essentially of Co in an amount of from about 5 to about 25 vol % of the cermet body and Cr in an amount such that an atomic Cr:Co ratio is from about 0.025 to about 0.14, and a plurality of grains having TiC cores and Ti—W—C rims, wherein an atomic Ti:W ratio is between about 2.5 and about 10, wherein the cermet body is essentially free from nitrogen, wherein the cermet body is essentially free of a grains having Ti—W—C cores, and wherein the TiC cores in the plurality of grains are undissolved TiC cores originating from TiC added as raw material.

14. A sintered cermet body according to claim 13 wherein the Cr:Co atomic ratio is from about 0.035 to about 0.09.

15. A sintered cermet body according to claim 13 wherein the cobalt is in an amount of from about 5 to about 12 vol % and where the cermet body has a hardness of from about 1700 to about 2500 HV3.

16. A sintered cermet body according to claim 13 wherein the cobalt is in an amount of from about 12 to about 25 vol % and where the cermet body has a hardness of from about 1400 to about 2000 HV3.

17. A sintered cermet body according to claim 13 wherein the atomic Ti:W ratio is from about 4.5 to about 10.

18. A sintered cermet body according to claim 13 wherein the atomic Ti:W ratio is from about 2.5 to about 4.5.

19. A sintered cermet body according to claim 13 wherein the atomic Ti:W ratio is from about 3 to about 4.5.

20. A sintered cermet body according to claim 13 wherein the amount of Co in the cermet body is from about 8 to about 17 vol % Co.

21. A sintered cermet body according to claim 13 wherein the cermet body has a porosity of between A00B00 and A04B02.

22. A sintered cermet body according to claim 13 wherein the ratio $x_{TiC}=TiC_{ALR}/TiC_{VR,raw}$, where $TiC_{ALR}$ is the TiC-average length ratio of the undissolved TiC cores in the sintered cermet body and $TiC_{VR,raw}$ is the volume fraction of the TiC in the raw material, is larger than about 1/5.

23. A sintered cermet body comprising:

a binder phase, wherein the binder phase consists essentially of Co, in an amount of from about 5 to about 25 vol % of the cermet body, and Cr, and a plurality of grains including a core of undissolved TiC and a rim of (Ti,W)C, wherein an atomic Ti:W ratio is between about 2.5 and about 10, wherein an atomic Cr:Co ratio is from about 0.025 to about 0.14, wherein the cermet body is essentially free from nitrogen, wherein the undissolved TiC cores originate from TiC added as raw material, and wherein the ratio $x_{TiC}=TiC_{ALR}/TiC_{VR,raw}$, where $TiC_{ALR}$ is the TiC-average length ratio of the undissolved TiC cores in the sintered cermet body and $TiC_{VR,raw}$ is the volume fraction of the TiC in the raw material, is larger than about 1/4.

24. A sintered cermet body according to claim 23 wherein the ratio $x_{TiC}=TiC_{ALR}/TiC_{VR,raw}$, is larger than about 1/3.

* * * * *